US005423468A

United States Patent [19]

Liedtke

[11] Patent Number: 5,423,468

[45] Date of Patent: Jun. 13, 1995

[54] AIR BEARING WITH POROUS OUTER TUBULAR MEMBER

[76] Inventor: Rudolph J. Liedtke, 1004 Yorkshire, Grosse Pointe Park, Mich. 48230

[21] Appl. No.: 750,218

[22] Filed: Aug. 19, 1991

Related U.S. Application Data

[63] Continuation of Ser. No. 521,990, May 11, 1990, abandoned.

[51] Int. Cl.[6] ..... B65H 23/00

[52] U.S. Cl. ..... 226/97; 226/196

[58] Field of Search ..... 226/7, 97, 95, 194, 226/196, 197

[56] References Cited

U.S. PATENT DOCUMENTS

| | | | |
|---|---|---|---|
| 3,156,399 | 11/1964 | Wadey | 226/97 |
| 3,245,334 | 4/1966 | Long | 95/89 |
| 3,744,693 | 7/1973 | Greiner | 226/97 |
| 4,416,201 | 11/1983 | Kessler | 29/125 X |
| 4,453,465 | 6/1984 | Heller et al. | 226/197 X |
| 4,506,841 | 3/1985 | Hood | 226/97 X |

FOREIGN PATENT DOCUMENTS

| | | | |
|---|---|---|---|
| 0267648 | 11/1988 | Japan | 226/97 |

*Primary Examiner*—Daniel P. Stodola
*Attorney, Agent, or Firm*—Basile and Hanlon

[57] ABSTRACT

An air bearing supports and guides a moving web with a linearly constant distribution of air between the bearing and the moving web. An exterior tubular member is fixedly mounted over a first tubular member having a central bore connected to a pressurized air source. Air flow apertures are formed in the first tubular member in fluid flow communication with the central bore in the first tubular member. The exterior tubular member is formed of a porous, air permeable material to evenly distribute air flow from the air flow apertures in the first tubular member evenly about the periphery of the exterior tubular member to form a linearly constant, even distribution of air across the length of the exterior tubular member to evenly support a moving web.

5 Claims, 1 Drawing Sheet

AIR BEARING WITH POROUS OUTER TUBULAR MEMBER

This application is a continuation of application Ser. No. 07/521,990, filed on May 11, 1990, now abandoned.

BACKGROUND OF THE INVENTION

1. Field of the Invention

The present invention relates, in general, to fluid bearings and, more specifically, to air bearing for supporting moving webs or substrates.

2. State of the Art

Moving webs or substrates, such as paper, cellophane and foil that have printing formed thereon as the result of a printing operation, such as a web offset lithography, are guided and supported in a continuous path which may contain turns ranging between 0° and 180°. The direction of movement of the web is changed to align the continuously moving web with devices that fold, cut or perforate the final product. In addition, a 180° re-orientation of the moving web to reverse the sides of the web (the bottom side becomes uppermost) and allow both sides of the web to be printed without a "perfecting" printing press which prints both sides simultaneously is sometimes desirable.

It is necessary to support the web a short distance above any bearing to prevent smearing of the fresh ink disposed on the web. A typical fluid or air bearing employed in web offset lithography is in the form of a hollow, chromed metallic cylinder having apertures arranged in one or more spaced rows in the peripheral side walls thereof. A hollow bore is formed in the cylinder and is connected to an air source such that air flows through the bore and the apertures in the side walls of the cylinder outward from the cylinder to create a thin cushion of air surrounding the cylinder. The cushion of air extends a short distance above the periphery of the cylinder to frictionlessly support and guide the web about the roller without contact between the web and the bearing.

One or more spaced rows of apertures are formed in the cylinder depending upon how much surface area of the web or substrate passes over the cylinder. Typically, the apertures in the cylinder result in uneven air distribution across the width of the web. Each high point is located above an aperture in the cylinder and low points are formed between two spaced apertures in the cylinder. The web occasionally contacts the cylinder at the low points which smears the fresh ink deposited on the web by the printing process.

Various attempts have been made to overcome these problems with previously deviced air bearings for use in web processes. Such attempts utilize rollers or bearings formed of porous, air permeable materials as disclosed in U.S. Pat. Nos. 3,245,334 and 3,744,693. In U.S. Pat. No. 3,245,334, a cylindrical member formed of a porous, air permeable material is stationarily mounted in a chamber through which a web passes. Air injected through a bore in the cylinder flows through the cylindrical member and forms a cushion of air a short distance above the periphery of the cylinder to support the web above the cylinder as the web moves past the cylinder. In one embodiment of U.S. Pat. No. 3,744,693, a stationarily mounted, hemispherically shaped turning bar is provided with a plurality of spaced apertures which form air flow paths for air supplied to the interior of the turning bar. A flexible sheet of a porous material is stretched and clamped under tension over the periphery of the turning bar to disperse air flowing through the apertures in the turning bar evenly about the periphery of the turning bar.

However, in both of the above-described devices, the air flow cylinder or turning bars stationarily mounted. This provides an even distribution of air only over a portion or one side of the cylindrical member and does not provide a full 360° cushion. This restricts such air bearings to applications where the web is redirected less than 180° from its original path.

Thus, it would be desirable to provide an air bearing which overcomes the above-identified problems encountered with previously deviced air bearings. It would also be desirable to provide an air bearing which is simple in construction. It would also be desirable to provide an air bearing which is usable with conventional, apertured air cylinders in new and retrofit applications. Finally, it would be desirable to provide an air bearing which provides a full 360° air cushion about the periphery of the bearing to enable the air bearing to redirect moving webs more than 90° from their original path.

SUMMARY OF THE INVENTION

The present invention is an air bearing for use in moving web processes which provides a linear constant distribution of air across the length of the bearing to prevent contact between the moving web and the bearing, yet support the web as it passes over the bearing.

The air bearing includes a first tubular member having a longitudinally extending, centrally located bore. A plurality of air flow apertures are formed in the first tubular member and are disposed in fluid flow communication with the longitudinal bore. A second tubular member having a longitudinally extending bore is slidably disposable over the first tubular member. The second tubular member is formed of a porous, air permeable material to direct air from the apertures in the first tubular member through the second tubular member.

In a preferred embodiment, both of the first and second tubular members have a circular cross section.

In a preferred embodiment, the second tubular member is formed of a porous plastic material. The plastic material is preferably polyethylene having a porosity hole diameter of approximately 25 microns and a void space between substantially 40% and 50% of total volume.

The air bearing of the present invention overcomes many of the deficiencies encountered with previously devised air bearings in that it supplies a linearly constant distribution of air completely across the length of the bearing. By constructing a tubular body formed of a porous, air permeable material which is slidably disposable over a conventional solid rotary bearing having spaced air flow apertures formed therein, the air bearing of the present invention may be used in retrofit applications with existing solid rollers or bearings as well as in new applications. The air bearing of the present invention is inexpensive and simple in construction. Further, the air bearing of the present invention uniquely provides a linearly constant distribution of air across the length of the bearing which prevents any damaging contact between the moving web and the bearing.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
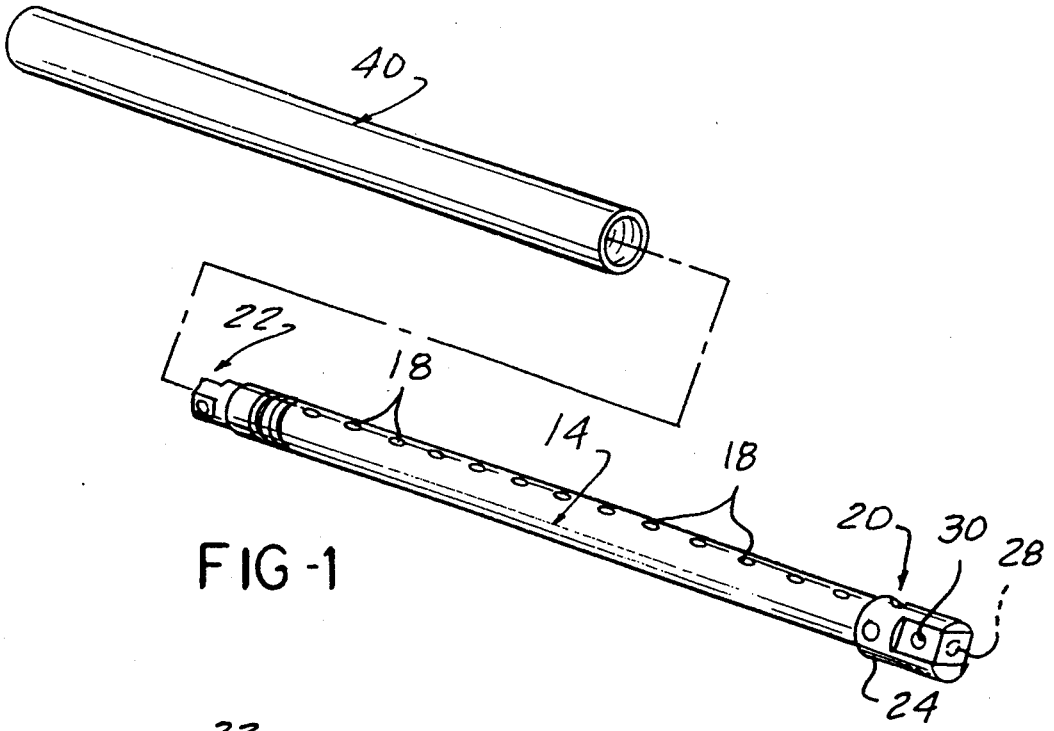
FIG. 1 is an exploded, perspective view of the air bearing of the present invention.

Throughout the following description and drawing, an identical reference number is used to refer to the same component shown in multiple figures of the drawing.

Figure 2:
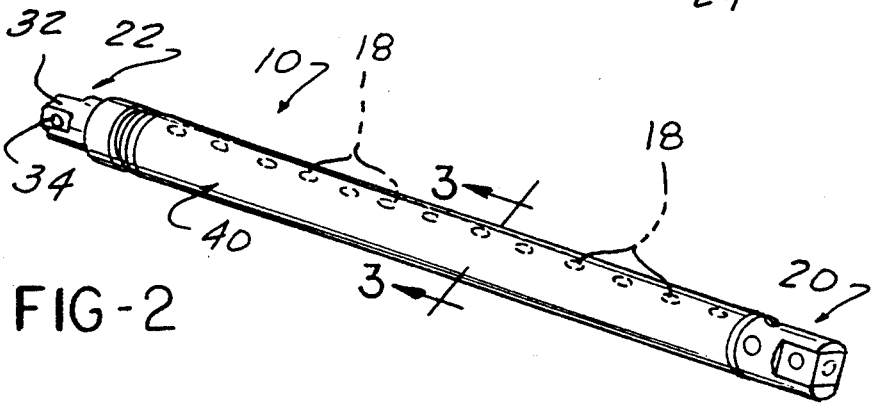
FIG. 2 is an assembled, perspective view of the air bearing shown in FIG. 1.
Figure 3:
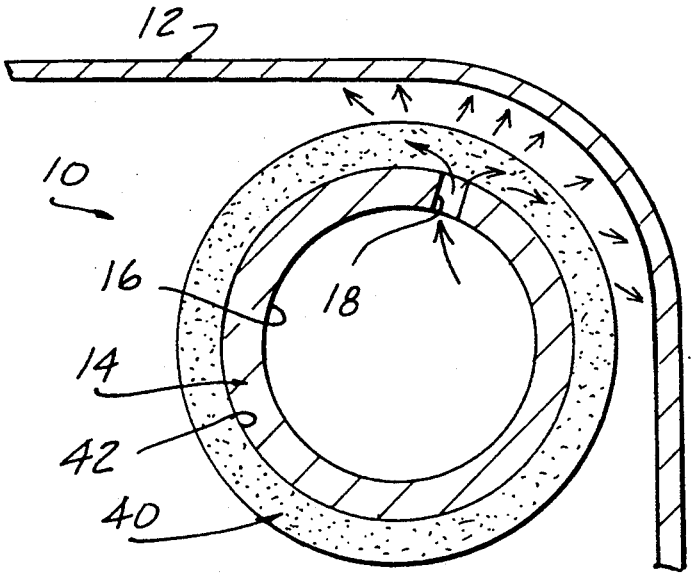
FIG. 3 is an enlarged cross sectional view generally taken along line 3—3 in FIG. 2.

Referring now to FIGS. 1, 2 and 3 of the drawing, there is illustrated an air bearing 10 which provides an evenly distributed, linearly constant cushion of air across its exterior length to support and guide a web or substrate above the bearing 10 as the web 23 passes thereover.

The air bearing 10 includes a first tubular member 14. The first tubular member 14 is preferably in the form of an elongated, hollow cylinder having a through bore 16 extending therethrough. The through bore 16 is open on one end of the first tubular member 14 and closed at the other end.

Preferably, the first tubular member 14 is formed of a suitable material, such as steel, etc. The exterior surface of the first tubular member 14 does not have to be specially coated, such as with a chrome layer as in the prior art.

A plurality of air flow apertures 18 are formed in the side wall of the first tubular member 14 and disposed in fluid flow communication with the bore 16 extending through the first tubular member 14. Preferably, the air flow apertures 18 are in the form of holes or milled slots which are spaced apart in a row. One or more rows of such air flow apertures 18 may be formed in the first tubular member 14 depending upon how much surface area of the web 12 passes over the air bearing 10.

By way of background, the web 12 may comprised any suitable material, such as paper, cellophane, foil, etc., which has printing formed on one or both sides as a result of printing processes, such as web offset lithography. Typically, during such printing processes, the web 12 must be redirected at least 90° from its original path to align the web or substrate 12 with devices the subsequently fold, cut or perforate the final product. In addition, two bearings, such as the air bearing 10, may be employed in a spaced pair to provide a 180° reorientation of the web 12 to reverse the sides of the web 12, such that the bottom side is disposed uppermost. This allows both sides of the web 12 to be printed without the need for a "perfecting" printing press which prints both sides of a web simultaneously.

As shown in FIGS. 1 and 2, the first tubular member 14 is provided with suitable end couplings 20 and 22. The end couplings 20 and 22 are described by way of example only as any suitable coupling may be employed to fixedly mount the first tubular member 14 to surrounding support structure, not shown. The first coupling 20 is mounted on one end of the first tubular member 14. The first coupling 20 includes an enlarged collar 24 and a fitting 26. A bore 28 extends through the fitting 26 and is disposed in fluid flow communication with the bore 16 in the first tubular member 14. A mounting aperture 30 is also formed in the fitting 26 to attach one end of the first tubular member to support structure by suitable means, such as welding.

The coupling means 22 is mounted on the opposite end of the first tubular member and includes a suitable fitting 32 having a transverse aperture 34 formed therein for mounting to support structure.

Not shown in FIGS. 1 and 2 is as a fluid supply source which supplies pressurized fluid, such as air, through the bore 28 to the bore 16 in the first tubular member 14.

The air bearing 10 also includes a second tubular member 40. The second tubular member 40 is preferably in the form of an elongated cylinder having a centrally located, longitudinally extending, through bore 42 extending between opposite ends. The internal diameter of the bore 42 is sized to enable the second tubular member 40 to be slidably disposed about the periphery of the first tubular member 14, with the interior surface of the bore 42 of the second tubular member 40 disposed in contact with the peripheral surface of the first tubular member 14. Either a press fit connection between the first and second tubular members 14 and 40 may be employed or other fastening means, such as machined lands, captive nuts, etc., may be used to fixedly connect the second tubular member 40 to the first tubular member 14.

The second tubular member 40 is preferably formed of a porous, air permeable material which contains pores which disperse air flowing through the air flow apertures 18 in the first tubular member 14 evenly through the side wall or thickness of the second tubular member 40. The second tubular member 40 may be formed in the desired, cylindrical shape by any suitable means, such as by extruding, molding, machining, etc.

Preferably, the second tubular member 40 is formed of a porous, plastic material which is extruded to the desired shape. By way of example only, the plastic material is preferably polyethylene and has a porosity of 25 microns and a void space of approximately 40% to 50% of total volume. The wall thickness of the second tubular member 40 is 0.25 inches in an exemplary application.

In assembling and using the air bearing 10 of the present invention, the second tubular member 40 is slid over the first tubular member 14 and fixed in place through a press fit or the use of separate fastening means, as described above. In this mounting arrangement, the pores in the second tubular member 40 are disposed in fluid flow communication with the air flow apertures 18 and the bore 16 in the first tubular member 14. This allows pressurized air supplied to the bore 16 in the first tubular member 14 to pass through the air flow apertures 18 in the first tubular member 14 and be evenly dispersed through the pores in the second tubular member 40. Air exiting from the peripheral surface of the second tubular member 40, as shown in FIG. 3, provides a linearly constant, evenly distributed cushion of air across the entire length of the second tubular member 40. This linearly constant, even distribution of air provides a cushion for supporting the web 12 at a constant distance above the peripheral surface of the second tubular member 40 as the web 12 passes over the air bearing 10. Further, since the cushion of air extends over the entire length of the second tubular member 40 for a predetermined angular portion of the exterior surface of the second tubular member 40, such as approximately 180°, the web 12 is prevented from damaging contact with the air bearing 10 even in applications where the web 12 is redirected a full 180° about the air bearing 10.

In summary, there has been disclosed a unique air bearing which provides a linearly constant, even distribution of air across the entire length of the bearing. This provides an even distribution or cushion of air which prevents damaging contact between a moving web and the air bearing.

What is claimed is:

1. An air bearing for supporting and guiding a moving web therepast by a cushion of air comprising:

a first tubular member having a longitudinal bore extending therethrough;

a plurality of spaced air flow apertures formed in the first tubular member and disposed in fluid flow communication with the longitudinal bore in the first tubular member, the air flow apertures extending over a major portion of the length of the first tubular member and only over a predetermined limited angular portion of the first tubular member; and a second tubular member having a longitudinal bore extending therethrough slidably disposable over the first tubular member and a side wall surrounding the bore and disposed in contact with the first tubular member substantially along the entire surface of the longitudinal bore;

the second tubular member being formed of a porous, air permeable material having non-linear air flow pores extending through at least a predetermined angular portion of the circumference of the side wall thereof, the air flow pores directing air from the air flow apertures in the first tubular member evenly through the predetermined angular portion of the second tubular member to form a linearly constant for the predetermined limited angular portion of the periphery of the second tubular member greater than the limited angular portion extent of the air flow apertures in the first tubular member to space the web from the second tubular member.

2. The air bearing of claim 1 wherein the first and second tubular members have a circular cross section.

3. The air bearing of claim 1 wherein the second tubular member is formed of a porous plastic.

4. The air bearing of claim 3 wherein the plastic is polyethylene having a porosity hole diameter of substantially 25 microns and a void space between 40% and 50% of total volume.

5. The air bearing of claim 1 wherein the plurality of air flow apertures in the first tubular member are co-linearly arranged in at least one row.

* * * * *